US005656417A

United States Patent [19]

Endoh et al.

[11] Patent Number: 5,656,417

[45] Date of Patent: Aug. 12, 1997

[54] PROCESS FOR PREPARING COLOR LIGHT-SENSITIVE MATERIAL BY MULTI LAYER CO-COATING

[75] Inventors: Akira Endoh; Masahiro Morikawa, both of Kanagawa, Japan

[73] Assignee: Fuji Photo Film Co., Ltd., Kanagawa, Japan

[21] Appl. No.: 319,090

[22] Filed: Oct. 6, 1994

Related U.S. Application Data

[63] Continuation of Ser. No. 13,225, Feb. 1, 1993, which is a continuation of Ser. No. 645,868, Jan. 25, 1991.

[30] Foreign Application Priority Data

Jan. 25, 1990 [JP] Japan ..... 2-13745

[51] Int. Cl.$^6$ ..... G03C 1/015

[52] U.S. Cl. ..... 430/502; 430/503; 430/935

[58] Field of Search ..... 430/502, 503, 430/532, 935

[56] References Cited

U.S. PATENT DOCUMENTS

| | | | |
|---|---|---|---|
| 3,928,678 | 12/1975 | Jackson | 430/935 |
| 4,001,024 | 1/1977 | Dittman et al. | 427/414 |
| 4,113,903 | 9/1978 | Choinski | 427/420 |
| 4,569,863 | 2/1986 | Koepke et al. | 430/935 |
| 4,851,268 | 7/1989 | Kozak | 427/420 |
| 4,946,769 | 8/1990 | Arai et al. | 430/935 |
| 4,970,140 | 11/1990 | Heki et al. | 430/502 |
| 5,219,724 | 6/1993 | Kato et al. | 430/935 |

FOREIGN PATENT DOCUMENTS

| | | |
|---|---|---|
| 0329802 | 8/1989 | European Pat. Off. . |
| 3238905 | 4/1984 | Germany . |
| 2070459 | 9/1981 | United Kingdom . |

*Primary Examiner*—Hoa Van Le

*Attorney, Agent, or Firm*—Sughrue, Mion, Zinn, Macpeak & Seas

[57] ABSTRACT

A process for multi-layer, co-coating preparation of a silver halide color light sensitive material comprising co-coating at least eight coating liquid compositions simultaneously onto a traveling support to form at least eight total layers comprising a lowermost layer adjacent to the support and at least seven outer layers adjacent to the lowermost layer, wherein the at least eight coating liquid compositions comprise a lowermost layer coating liquid composition and at least seven outer coating liquid compositions; the lowermost layer coating liquid composition has a viscosity of 15 to 100 cp; each outer layer coating liquid composition of the at least seven outer layer liquid compositions has a viscosity of at least 30 cp; and the at least seven outer layer coating liquid compositions have an arithmetic mean viscosity of 60 to 300 cp.

23 Claims, 1 Drawing Sheet

PROCESS FOR PREPARING COLOR LIGHT-SENSITIVE MATERIAL BY MULTI LAYER CO-COATING

This is a continuation of application Ser. No. 08/013,225, filed on Feb. 1, 1993 which is continuation of 07/645,868, filed Jan. 25, 1991.

FIELD OF THE INVENTION

This invention relates to a process for preparing a color light-sensitive material, and more particularly to a process for preparing a color light-sensitive material which comprises applying coating liquid compositions for photographic layers, which comprises hydrophilic colloid solutions containing gelatin or a derivative thereof, at a high speed under good surface conditions.

BACKGROUND OF THE INVENTION

It has been conventionally required that coatings for light-sensitive materials be uniformly applied using coating liquid compositions to cover a support to form photographic layers such as photographic emulsion layers used in the production of photographic materials. In JP-A-52-115214 (corresponding to U.S. Pat. No. 4,001,024: the term "JP-A" as used herein means an "unexamined published Japanese patent application"), an attempt is made to form uniform coated layers by coating the lowermost layer with a low-viscosity coating composition having a viscosity of about 1 to 8 cp to form a thin lowermost layer and coating a layer just above the lowermost layer with a relatively high-viscosity coating composition having a viscosity of about 10 to 100 cp. In this method, the surface of a web is wetted by using the low-viscosity coating composition to form the lowermost layer so as to prevent a coating failure, or to act to improve the lower-coating liquid composition has good adhesion with upper layer.

JP-A-63-11934 discloses a method for preparing silver halide photographic materials wherein at least the lowermost layer is coated with a hydrophilic colloid solution containing a high-molecular weight compound having a sulfo group, a sulfuric ester group or a carboxyl group on its side chains and having a limiting viscosity number ([η], dl/g, measured in 0.1N of NaCl aqueous solution at 30° C.) of 0.4 to 1.8, at a rate of 80 to 300 m/min, when silver halide emulsions or other hydrophilic colloid layers are coated. This patent application discloses the production of photographic materials (including films), for example, by using a coating liquid composition whose viscosity is adjusted to 50 to 80 cp by adding poly(sodium p-styrenesulfonate) having [η]=1.0. This application also disclose a method wherein unevenness in coating is reduced.

With regard to multi-layer co-coating methods, a method using a multi-layer slide hopper is disclosed, for example, in JP-B-33-8977 (corresponding to U.S. Pat. No. 2,761,791: the term "JP-B" as used herein means an "examined Japanese patent publication"). This specification discloses that there is no limitation with regard to the number of layers to be co-coated with different coating liquid compositions which can be co-coated on a support by using a multiple slide hopper of this type.

However, such a method suffers the problems of non-uniform surfaces, due to unevenness in co-coating, which is expected to occur as fine irregularities on a support, as the number of layers in the coating is increased. There has been great difficulty in stably obtaining a uniform co-coated surface which is free from color non-uniformity, particularly at a high coating speed. Accordingly, layers have been conventionally coated by using two or more sets of coating procedures, when color photographic materials having many layers, particularly 8 or more layers are to be prepared.

The above process is illustrated in greater detail as follows. When 8 or more total layers of coating are provided by conventional multi-layer co-coating, non-uniformity in color density (that is, lack of color uniformity) is expected to occur due to various problems, e.g., bubbling on the slide surfaces of syringes, flow caused by irregularities on the surface of a support, a flow caused by setting air at the early stage of drying stage, and similar types of problems. These problems are liable to be remarkable by fluctuation of the coating amount when the concentration of each coating liquid composition is increased.

Accordingly, when 8 or more total photographic layers are to be co-coated, it is necessary that turbulence at the interface of the slide surface of the syringe is reduced, coating liquid compositions are co-coated on a support conveyed at a high speed without being affected by irregularities on the surface of the support and the co-coated surface is kept uniform at the drying stage.

SUMMARY OF THE INVENTION

An object of the present invention is therefore to overcome the above problems by providing a process for preparing a color light-sensitive material which has uniform color, and a uniform co-coated surface, by coating simultaneously (co-coating) eight or more total photographic layers by a single coating process.

Another object of the present invention is to provide a process for preparing a color light-sensitive material which has substantially reduced or eliminated fogging.

Still another object of the present invention is to provide a process for preparing a color light-sensitive material, particularly a color light-sensitive material for photographing, by a high-speed co-coating process.

Other objects of the present invention will become apparent from the following descriptions.

The above-described objects of the present invention have been achieved by providing:

(1) a process for multi-layer, co-coating preparation of a silver halide color light sensitive material comprising co/coating at least eight coating liquid compositions simultaneously onto a traveling support to form at least eight total layers comprising a lowermost layer adjacent to the support and at least seven outer layers adjacent to the lowermost layer, wherein the at least eight coating liquid compositions comprise a lowermost layer coating liquid composition and at least seven outer layer coating liquid compositions; the lowermost layer coating liquid composition has a viscosity of about 15 to 100 cp; each outer layer coating liquid composition of the at least seven outer layer coating liquid compositions has a viscosity of at least about 30 cp; and the at least seven outer layer coating liquid compositions have an arithmetic mean viscosity of about 60 to 300 cp.

(2) a process according to (1) above, wherein the at least eight total layers are coated in a total coating amount of at most about 300 ml/m$^2$; and each of the eight total layers is coated in a coating amount of at least about 3 ml/m$^2$.

DETAILED DESCRIPTION OF THE INVENTION

Figure 1:
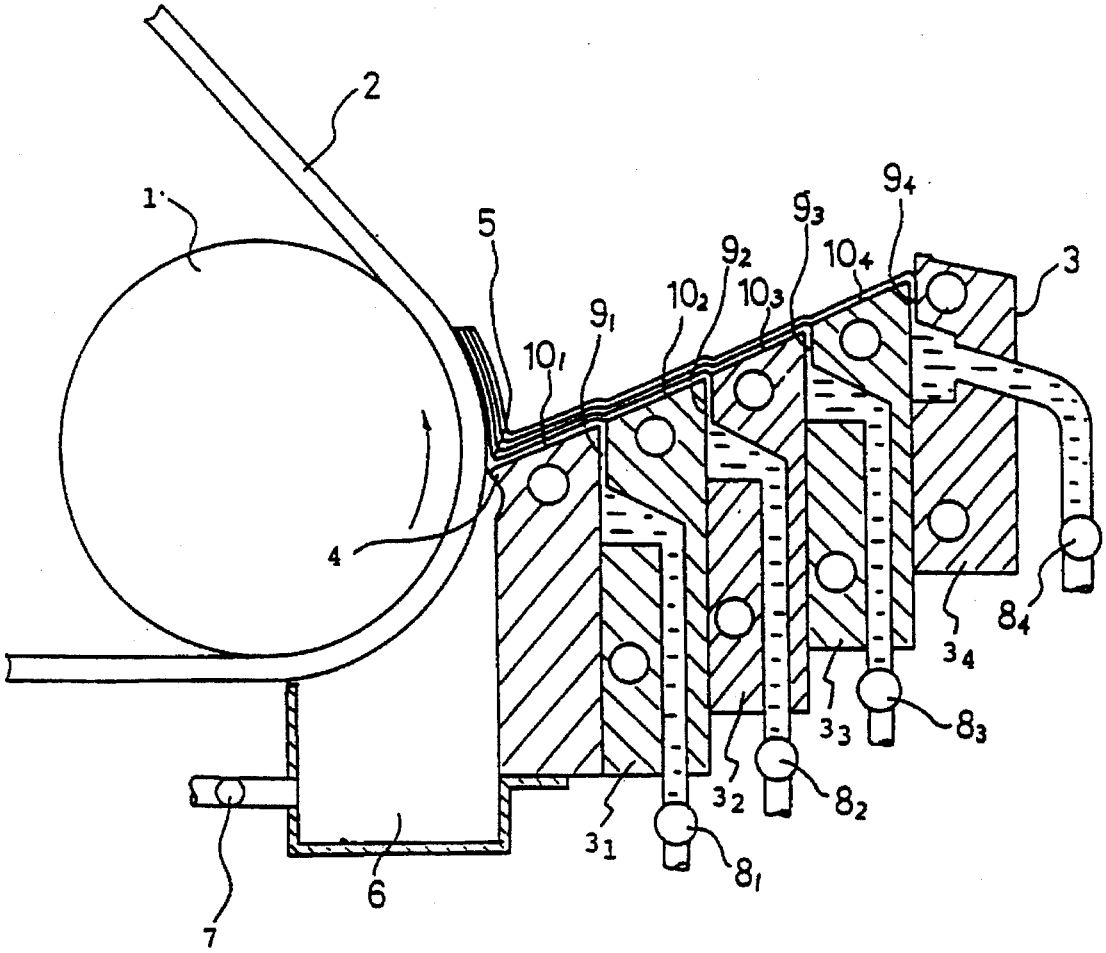
FIG. 1 is a cross-sectional view of an embodiment of a four layer co-coating apparatus which is one slide hopper type coating apparatus that can be used in a method of the present invention.

The present invention is illustrated in more detail as follows.

In the methods of the present invention, a coating liquid composition having a viscosity of about 15 to 100 cp is used to provide a lowermost layer adjacent to the support. This range of viscosity is preferred in methods of the present invention because, when a coating liquid composition having a viscosity of less than about 15 cp is used, color non-uniformity tends to be caused during the process of co-coating of eight or more total layers, and, additionally, when a viscosity of higher than about 100 cp is used, the coating is poorly formed and breakage of the coated liquid composition at both sides of the support tends to occur. The viscosity of a coating liquid composition to be used to form the lowermost layer is preferably about 20 to 70 cp, and more preferably about 20 to 60 cp.

In the present invention, any of the coating liquid compositions for at least seven outer layers (to be coated on the lowermost layer and these subsequent outer layers, in order) is preferred to have a viscosity of at least about 30 cp, and the arithmetic mean viscosity of the coating liquid compositions for the seven or more outer layers above the lowermost layer is preferred to be about 60 to 300 cp. This is because when each of coating liquid compositions for the seven or more outer layers (to be coated on the lowermost layer and subsequent outer layers) have a viscosity of less than about 30 cp, color non-uniformity tends to occur, while when the viscosity is higher than about 300 cp, there are difficulty in defoaming and delivering of the coating liquid compositions. The viscosity of each of the outer layers is preferably about 70 to 250 cp, and more preferably about 80 to 200 cp, in order to conduct stable coating. It is particularly preferred that the viscosity of the coating liquid composition for the second layer adjacent to the lowermost layer is higher than that of the coating liquid composition for the lowermost layer. In order to conduct stable coating the viscosity of the coating liquid composition for this second layer is preferably at least about 1.5 times, and more preferably about 1.8 to 5 times that of the coating liquid composition for the lowermost layer. From the similar reason as above, the viscosity of the coating liquid compositions for the at least seven outer layers is preferably adjusted so as to give an arithmetic mean viscosity for all other outer layers of about 60 to 300 cp, preferably about 70 to 250 cp, and more preferably 80 to 200 cp.

Generally, it is preferred that viscosities of layers present in the middle of the total layers have relatively higher viscosities.

The preferred temperature of the coating liquid composition is 39°±1° C.

The viscosity of each coating liquid composition can be adjusted to a predetermined value by adding an aqueous solution of one or more conventional thickening agents. A typical example of the thickening agent is poly (sodium p-styrenesulfonate). Other thickening agents can be include, e.g., vinyl polymers having a sulfo group, sulfuric ester group or carboxyl group (or in the form of a salt) on the side chains thereof, e.g., as described in JP-A-63-11934 can also be used as thickening agents in methods of the present invention.

The measurement of the viscosity can be made at a shear rate of 29.8 mm/sec (e.g., using the equivalent shear rate produced by rotor No. 1, 30 rpm, 40° C.) of a Brookfield type viscometer (e.g., type BL, manufactured by Tokyo Precision instrument Co., Ltd. or equivalent thereof).

In a preferred embodiment of the present invention, the coating amount of each coating liquid composition for each layer is at least about 3 ml/m$^2$. This is because when the coating amount is less than about 3 ml/m$^2$, wavy unevenness tends to occur on the slide surface of the slide hopper and uniform multilayer coatings cannot be made on the surface of the support under such conditions. More preferably, the coating amount of each coating liquid composition for each layer is about 5 to 50 ml/m$^2$. When any one of the coating liquid compositions is used in a coating weight of more than about 50 ml/m$^2$ to co-coat eight or more layers, color non-uniformity in the coated photographic layer tends to be formed.

It is preferred that the sum total of the co-coating amounts of the entire layers of the lowermost layer and seven or more outer layers (to be coated on the lowermost layer) is preferably less than about 300 ml/m$^2$. This is because when the sum total of the co-coating amounts exceeds more than about 300 ml/m$^2$, color non-uniformity in the coated photographic layers tends to occur. Further, when a reduction in drying conditions is taken into consideration, the sum total of the coating amounts of the entire layers is more preferably not more than about 250 ml/m$^2$.

Equipment outlined in JP-B-33-8977 (the contents of which are incorporated by reference) is preferably used as multi-layer co-coating equipment used in methods of the present invention. For example, slide hopper type coating equipment capable of co-coating nine or more layers, which is a type of a slide hopper for the co-coating of 4 layers, as shown in FIG. 1, can be used. pre-prepared coating liquid compositions are fed to 8 or more slits and coated so as to be placed in layers when they are allowed to flow down along slide surfaces.

An example of a slide hopper type co-coating equipment to be used in methods of the present invention is illustrated below, referring to FIG. 1.

The tip (4) of a slide hopper type syringe (3) is allowed to stand close to a support (2) at a given distance therebetween, said a support (2) traveling while supporting it on a back-up roller (1), whereby a coating liquid composition bridging area (called the bead part (5)) is formed therebetween to coat the support (2) with coating liquid compositions. The space between the support (2) and the tip (4) is called the bead space which may be in the same range as in conventional method. A vacuum chamber (6) for reducing the pressure of the back of the bead is provided to stabilize the bead part (5). Pressure is reduced by means of a vacuum pump (7). In this case, a degree of the reduction of pressure is called bead back pressure which may be in the same range as in conventional method.

An example of a slide hopper type syringe in multi-layer co-coating equipment to be used in processes of the present invention is illustrated below. Each coating liquid composition for each of n-layers (multilayer is referred to as n-layers) is delivered to each syringe $(\mathbf{3})_{(1\sim n)}$ by means of each of liquid feed pumps $(\mathbf{8})_{(1\sim n)}$, and passed through each of slits $(\mathbf{9})_{(1\sim n)}$ to form a thin film of each coating liquid composition over the whole surface in width of the support (2), and each coating liquid composition in the form of said thin film is allowed to flow out on the surface of each of slide surfaces $(\mathbf{10})_{(1\sim n)}$. The coating liquid compositions flow out and form thin films superimposed on one another, in order, the solution flowed from the upper portion to that of the lower portion. An n-layer-superposed coating liquid composition film is formed in the bead part and coated onto the support.

This co-coating type is called a slide hopper type, wherein the coating liquid compositions are superimposed on one another on the slide surfaces.

The present invention can be used as a multi-layer co-coating method for co-coating (simultaneously coating) at least 8 total layers. Generally, n can equal about 8 to 20 total layers and these can be co-coated (simultaneously coated), but the present invention can preferably be used as a multi-layer co-coating method for co-coating 10 to 18 layers (n=10 to 18). The coating rate of the present invention in the production of color light-sensitive materials can be applied to the support which is traveling at a coating rate of preferably about 30 to 500 m/min. The coating rate is preferably about 50 to 300 m/min, and most preferably about 70 to 200 m/min.

Examples of the coating composition include light sensitive or insensitive silver halide emulsions, liquid compositions for a protective layer, an intermediate layer, a yellow filter layer and an ultraviolet absorbing layer. Usually, gelatin or other hydrophilic colloids (with gelatin) are used as binders.

The coated photographic layers are generally dried in conventional manners as follows.

The coated photographic layers are immediately cooled after coating to solidify them. In order to conduct cooling, the coated photographic layers usually are brought into contact with low-temperature air which is cooled to a dry-bulb temperature preferably of about −10° C. to 20° C. In this way, the thus-produced coated films are cooled to solidify them and drying of the solidified films is then carried out by means of conventional gas (e.g., dried air) spraying.

It is preferred that the drying with a gas spray is carried out by spraying air at a dry-bulb temperature of about 15° to 45° C. and a RE (relative humidity) of about 10 to 50%, with an air flow of about 10 to 40 $m^3/m^2$·min, because an increase in fogging, caused by drying, can thus be prevented.

The drying time varies depending on the amount of wet coatings and drying conditions, but is preferred to be generally about 0.5 to 5 minutes.

It is further preferred that the thus-dried coating films are further subjected to moisture conditioning with air at a dry-bulb temperature of about 20° to 40° C. and a RH of about 50 to 70%.

Processes for preparing a light-sensitive material according to the present invention can be applied to transparent, semitransparent or reflective supports. Typical examples of the transparent supports include cellulose triacetate and polyethylene terephthalate supports. Examples of the reflective supports include polyethylene-laminated paper supports which are generally used for light-sensitive materials for color prints. According to processes of the present invention, products are substantially not affected by irregularities on the surface of the support, in comparison with products produced by conventional processes. Even when the supports have the deepest irregularities of up to about 5 μm, light-sensitive material having good surface conditions can be obtained at a high coating speed by processes of the present invention. It is desirable that the space between the pitches of the irregularities on surfaces of the support having irregularities is not in the range of about 0.5 to 8 mm, and it is more desirable that the space is not in the range of about 5 to 8 mm. Shorter or longer space is suitable for methods of the present invention. When the space between pitches is shorter than about 0.5 mm or longer than about 8 mm, the uniformity of coating is substantially not adversely affected by the presence of irregularities. It is preferable that the support has an undercoating.

The present invention is now illustrated in greater detail by reference to the following examples which, however, are not to be construed as limiting the present invention in any way.

EXAMPLE 1

A cellulose triacetate film support having an antihalation layer as a back layer was coated with the following first to ninth layers (as a first lowermost layer and eight outer layers) having the following compositions in this order from the side of the support. Conditions A to E are co-coating method, and condition F is coating method conducted by dividing the co-coating to two operations, to prepare a reversal color film having photographic sensitivity of 100.

Conditions A to E were multi-layer co-coating conditions for co-coating 9 layers. The viscosity of each coating liquid composition, the arithmetic mean viscosity of the coating liquid compositions for seven or more outer layers excluding the lowermost layer, the coating amount of each layer and the sum total of the coating amounts for all of the layers were adjusted to those indicated in Table 1.

TABLE 1

| Coated Layer | | Viscosity (cp) | | | | | | Coating Amount ($ml/m^2$) | |
|---|---|---|---|---|---|---|---|---|---|
| No. Level | Condition | A | B | C | D | E | F | A–E | F |
| | | | | | | | First Time | | First Time |
| 1 | | 40 | 40 | 10 | 120 | 70 | 40 | 20 | 40 |
| 2 | | 40 | 100 | 100 | 100 | 280 | 40 | 20 | 40 |
| 3 | | 40 | 100 | 100 | 100 | 280 | 40 | 10 | 20 |
| | | | | | | | Second Time | | Second Time |
| 4 | | 40 | 100 | 100 | 100 | 280 | 40 | 20 | 20 |
| 5 | | 40 | 100 | 100 | 100 | 280 | 40 | 20 | 20 |
| 6 | | 40 | 100 | 100 | 100 | 280 | 40 | 10 | 10 |
| 7 | | 40 | 100 | 100 | 100 | 280 | 40 | 20 | 20 |
| 8 | | 40 | 100 | 100 | 100 | 280 | 40 | 20 | 20 |
| 9 | | 40 | 40 | 40 | 60 | 100 | 40 | 10 | 10 |
| Mean Viscosity | | 40 | 93 | 93 | 95 | 258 | — | — | — |
| Total coating Amount ($ml/m^2$) | | — | — | — | — | — | 150 | each 100 | |

Note:
Mean viscosity is the arithmetic mean value of the coating liquid compositions for the second to ninth layers. The coating amount of F is such that each of the first and second coating is 100 $ml/m^2$.

The adjustment of viscosity was made by adding a thickening agent composed of a 2% aqueous solution of poly(sodium p-styrenesulfonate) ([η]=1.0 dl/g) in a conventional manner.

Coating was carried out by using slide hopper type coating equipment. Coating conditions were such that coating speed was 100 m/min, bead back pressure was 30 mm $H_2O$ and the space between the hopper and the support at the bead part was 250 μm. The temperatures of the coating compositions were in the range of 38° to 39.5° C.

Each coating liquid composition for each layer had the following composition.

First Layer: First Red-sensitive Emulsion Layer (as the lowermost layer)

A gelatin layer (dry layer thickness: 2 μm) containing:

| | |
|---|---|
| Silver iodobromide emulsion spectral-sensitized with sensitizing dyes S-1 and S-2 (silver iodide content: 4 mol %, mean grain size: 0.3 μm): silver amount | 0.5 g/m² |
| Coupler (C-1) | 0.2 g/m² |
| Coupler (C-2) | 0.05 g/m² |
| High-boiling organic solvent (0-2) | 0.12 ml/m² |

Second Layer: Second Red-sensitive Emulsion Layer (as the first outer layer)

A gelatin layer (dry layer thickness: 2.5 μm) containing:

| | |
|---|---|
| Silver iodobromide emulsion spectral-sensitized with sensitizing dyes S-1 and S-2 (silver iodide content: 2.5 mol %, mean grain size: 0.55 μm): silver amount | 0.8 g/m² |
| Coupler (C-1) | 0.55 g/m² |
| Coupler (C-2) | 0.14 g/m² |
| High-boiling organic solvent (0-2) | 0.33 ml/m² |

High-boiling organic solvent (O-2) 0.33 ml/m²

Third Layer: Interlayer

A gelatin layer (dry layer thickness: 1 μm) containing:

| | |
|---|---|
| Compound (H-1) | 0.1 g/m² |
| High-boiling organic solvent (0-2) | 0.1 ml/m² |

Fourth Layer: First Green-sensitive Emulsion Layer

A gelatin layer (dry layer thickness: 1 μm) containing:

| | |
|---|---|
| Silver iodobromide emulsion spectral-sensitized with sensitizing dyes S-3 and S-4 (silver iodide content: 3 mol %, mean grain size: 0.3 μm): silver amount | 0.7 g/m² |
| Coupler (C-3) | 0.35 g/m² |
| High-boiling organic solvent (0–2) | 0.26 ml/m² |

Fifth Layer: Second Green-sensitive Emulsion Layer

A gelatin layer (dry layer thickness: 2.5 μm) containing:

| | |
|---|---|
| Silver iodobromide emulsion spectral-sensitized with sensitizing dyes S-3 and S-4 (silver iodide content: 2 mol %, mean grain size: 0.8 μm): | 0.7 g/m² |

-continued

| | |
|---|---|
| silver amount | |
| Coupler (C-4) | 0.25 g/m² |
| High-boiling organic solvent (0–2) | 0.05 ml/m² |

Sixth Layer: Yellow Filter Layer

A gelatin layer (dry layer thickness: 1 μm) containing:

| | |
|---|---|
| Yellow colloidal silver | 0.1 g/m² |
| Compound (H-1) | 0.02 g/m² |
| Compound (H-2) | 0.03 g/m² |
| High-boiling organic solvent (0–2) | 0.04 ml/m² |

Seventh Layer: First Blue-sensitive Emulsion Layer

A gelatin layer (dry layer thickness: 1.5 μm) containing:

| | |
|---|---|
| Silver iodobromide emulsion spectral-sensitized with sensitizing dye S-5 (silver iodide content: 2.5 mol %, mean grain size: 0.7 μm): silver amount | 0.6 g/m² |
| Coupler (C-5) | 0.5 g/m² |
| High-boiling organic solvent (0–2) | 0.1 ml/m² |

Eighth Layer: Second Blue-sensitive Emulsion Layer

A gelatin layer (dry layer thickness: 3 μm) containing:

| | |
|---|---|
| Silver iodobromide emulsion spectral-sensitized with sensitizing dye S-5 (silver iodide content: 2.5 mol %, mean grain size: 1.2 μm): silver amount | 1.1 g/m² |
| Coupler (C-5) | 1.2 g/m² |
| High-boiling organic solvent (0–2) | 0.23 ml/m² |

Ninth Layer: Protective Layer

A gelatin layer (dry layer thickness: 2.0 μm) containing:

| | |
|---|---|
| Ultraviolet light absorber (U-1) | 0.02 g/m² |
| Ultraviolet light absorber (U-2) | 0.03 g/m² |
| Ultraviolet light absorber (U-3) | 0.03 g/m² |
| Ultraviolet light absorber (U-4) | 0.29 g/m² |
| High-boiling organic solvent (0-1) | 0.28 ml/m² |
| Polymethyl methacrylate particles (average particle size: 1.5 μm) | 0.50 g/m² |

In addition to the above-described composition, a hardening agent H-3 for gelatin and surfactant were added to each layer.

The compounds used for the preparation of the sample, that is, (C-1), (C-2), (C-3), (C-4), (C-5), (U-1), (U-2), (U-3), (U-4), (H-1), (H-2), (H-3), (O-1), (O-2), (S-1), (S-2), (S-3), (S-4), (S-5) had the following chemical structural formulas.

(C-1):
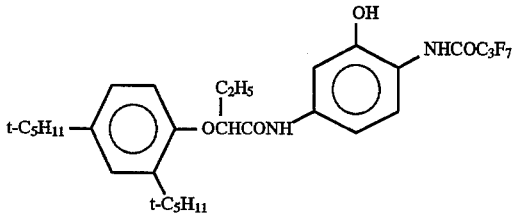
(C-2):
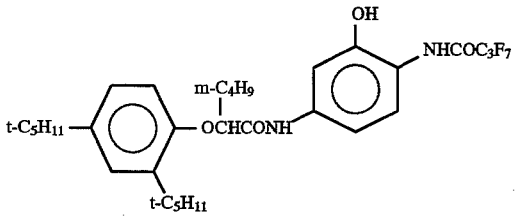
(C-3):
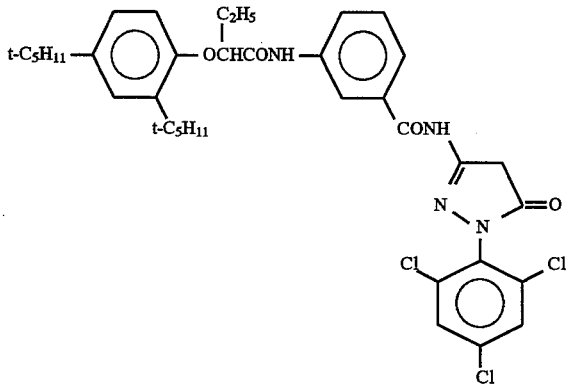
(C-4):
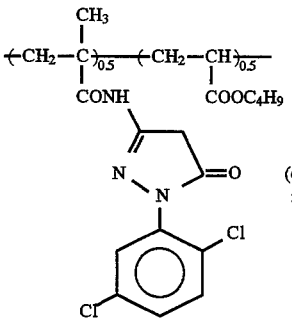
(copolymerization ratio is by weight)
-continued
(C-5):
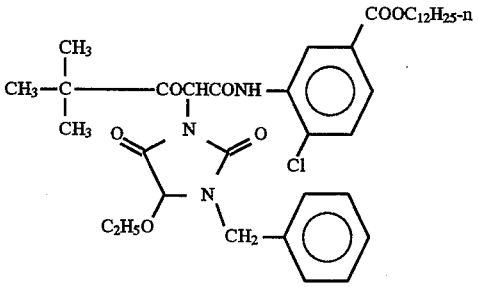
(U-1):
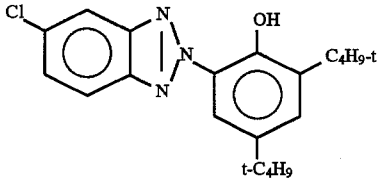
(U-2):
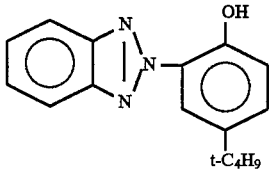
(U-3):
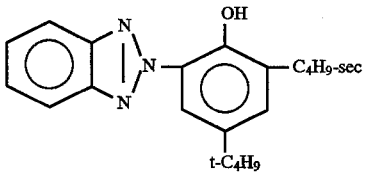
(U-4):
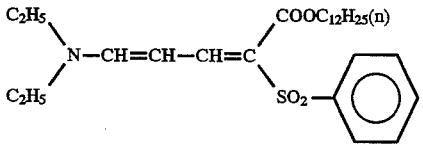
(H-1):
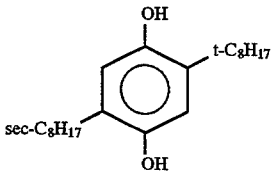

-continued

H-2:

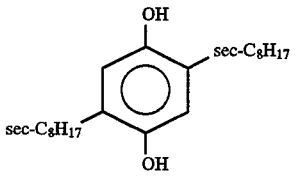

(H-3):

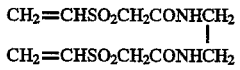

(O-1):

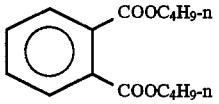

(O-2):

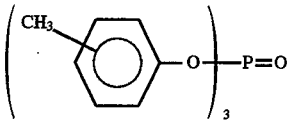

(a mixture of compounds)

(S-1):

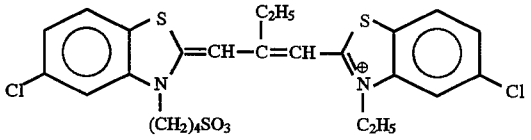

(S-2):

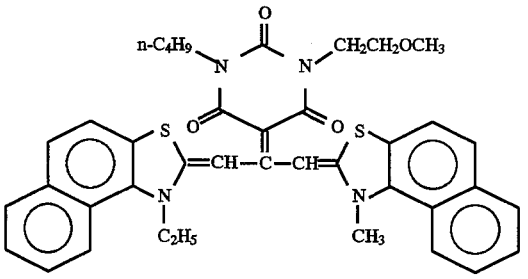

(S-3):

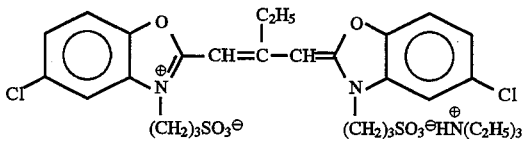

-continued (S-4):

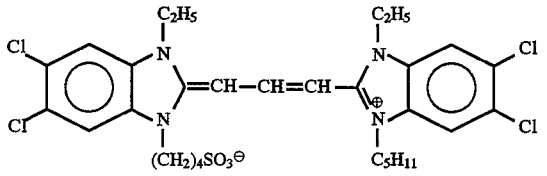

(S-5):

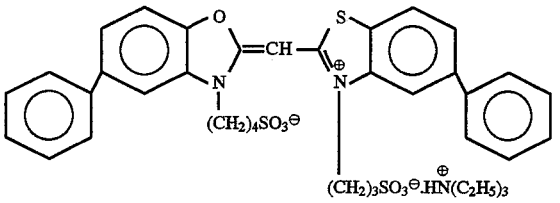

The coated support was dried using a helical drying method with drying air at a dry-bulb temperature of 37° C. and a RH of 20% for 3 minutes and then wound up.

Each of the resulting samples was subjected to sensitometry under standard conditions. The conditions A to E provided the same fog density. With the regard to an effect of the number of times of coating, the fog value of the red-sensitive layers of the co-coated products obtained by Conditions A to E was lower by 0.03 than that of Condition F wherein coating was conducted by dividing to twice. It is clear from this result that co-coating is effective in lowering the fog value of the red-sensitive layer.

Further, the coated surfaces of each sample were observed by visual inspection, and the following results were obtained.

Condition A: Color non-uniformity corresponding to the irregularities of the base was formed.

Condition B: Color non-uniformity was not found and the coated surface was good.

Condition C: Color non-uniformity in the form of the scale of fish was formed.

Condition D: Wavy color non-uniformity was formed.

Condition E: Color non-uniformity was not found and the coated surface was good.

Condition F: Color non-uniformity was not found, but the fog value of the red-sensitive layer was higher by 0.03 than that of other samples as mentioned above.

It is apparent from the above results that the Conditions B and E, which meet requirements according to the present invention, do not cause the formation of color non-uniformity.

EXAMPLE 2

An undercoated cellulose triacetate film support was co-coated with the following layers having the following compositions by means of multi-layer co-coating method to prepare a sample which was a negative type multi-layer color light-sensitive material having photographic sensitivity of about 400.

The adjustment of viscosity was made by adding a thickening agent composed of the aqueous solution of poly(sodium p-styrene-sulfonate) which was used in Example 1 in a conventional manner.

Composition of Photographic Layer

Numerals given below to the ingredients represent coating weight (g/m$^2$). The amounts of silver halide emulsions are represented by coating weight in terms of silver. The amounts of sensitizing dyes are represented by mol per mol of silver halide in the same layer.

| Sample 101 | |
|---|---|
| First Layer: Antihalation Layer | |
| Black colloidal silver | 0.18 as silver |
| Gelatin | 1.40 |
| Second Layer: Interlayer | |
| 2,5-Di-t-pentadecylhydroquinone | 0.18 |
| (EX-1) | 0.07 |
| (EX-3) | 0.02 |
| (EX-12) | 0.002 |
| (U-1) | 0.06 |
| (U-2) | 0.08 |
| (U-3) | 0.10 |
| (UBS-1) | 0.10 |
| (UBS-2) | 0.02 |
| Gelatin | 1.04 |
| Third Layer: First Red-sensitive Emulsion Layer | |
| Emulsion A | 0.25 as silver |
| Emulsion B | 0.25 as silver |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| (EX-2) | 0.335 |
| (EX-10) | 0.020 |
| (U-1) | 0.07 |
| (U-2) | 0.05 |
| (U-3) | 0.07 |
| (HBS-1) | 0.060 |
| Gelatin | 0.87 |
| Fourth Layer: Second Red-sensitive Emulsion Layer | |
| Emulsion G | 1.0 as silver |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| (EX-2) | 0.400 |
| (EX-3) | 0.050 |
| (EX-10) | 0.015 |
| (U-1) | 0.07 |
| (U-2) | 0.05 |
| (U-3) | 0.07 |
| Gelatin | 1.30 |
| Fifth Layer: Third Red-sensitive Emulsion Layer | |
| Emulsion D | 1.60 as silver |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| (EX-3) | 0.010 |
| (EX-4) | 0.080 |
| (EX-2) | 0.097 |
| (HBS-1) | 0.22 |
| (HBS-2) | 0.10 |
| Gelatin | 1.63 |
| Sixth Layer: Interlayer | |
| (EX-5) | 0.040 |
| (HBS-1) | 0.020 |
| Gelatin | 0.80 |
| Seventh Layer: First Green-sensitive Emulsion Layer | |
| Emulsion A | 0.15 as silver |
| Emulsion B | 0.15 as silver |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| (EX-6) | 0.260 |
| (EX-1) | 0.021 |
| (EX-7) | 0.030 |
| (EX-8) | 0.025 |
| (HBS-1) | 0.100 |
| (HBS-3) | 0.010 |
| Gelatin | 0.63 |
| Eighth Layer: Second Green-sensitive Emulsion Layer | |
| Emulsion C | 0.45 as silver |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| (EX-6) | 0.094 |
| (EX-8) | 0.018 |
| (EX-7) | 0.026 |
| (HBS-1) | 0.160 |
| (HBS-3) | 0.008 |
| Gelatin | 0.50 |
| Ninth Layer: Third Green-sensitive Emulsion Layer | |
| Emulsion E | 1.2 as silver |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| (EX-13) | 0.015 |
| (EX-11) | 0.100 |
| (EX-1) | 0.025 |
| (HBS-1) | 0.25 |
| (HBS-2) | 0.10 |
| Gelatin | 1.54 |
| Tenth Layer: Yellow Filter Layer | |
| Yellow colloidal silver | 0.05 as silver |
| (EX-5) | 0.08 |
| (HBS-1) | 0.03 |
| Gelatin | 0.95 |
| Eleventh Layer: First Blue-sensitive Emulsion Layer | |
| Emulsion A | 0.08 as silver |
| Emulsion B | 0.07 as silver |
| Emulsion F | 0.07 as silver |
| Sensitizing Dye VIII | $3.5 \times 10^{-4}$ |
| (EX-9) | 0.721 |
| (EX-8) | 0.042 |
| (HBS-1) | 0.28 |
| Gelatin | 1.10 |
| Twelfth Layer: Second Blue-sensitive Emulsion Layer | |
| Emulsion G | 0.45 as silver |
| Sensitizing dye VIII | $2.1 \times 10^{-4}$ |
| (EX-9) | 0.154 |
| (EX-10) | 0.007 |
| (HBS-1) | 0.05 |
| Gelatin | 0.78 |
| Thirteenth Layer: Third Blue-sensitive Emulsion Layer | |
| Emulsion H | 0.77 as silver |
| Sensitizing Dye VIII | $2.2 \times 10^{-4}$ |
| (Ex-9) | 0.20 |
| (HBS-1) | 0.07 |
| Gelatin | 0.69 |
| Fourteenth Layer: First Protective Layer | |
| Emulsion I | 0.5 as silver |

-continued

| Sample 101 | |
|---|---|
| (U-4) | 0.11 |
| (U-5) | 0.17 |
| (HBS-1) | 0.05 |
| Gelatin | 1.00 |
| Fifteenth Layer: Second Protective Layer | |
| Polymethylacrylate Particles (diameter: about 1.5 μm) | 0.54 |
| (S-1) | 0.20 |
| Gelatin | 1.20 |

In addition to the above-described ingredients, a hardening agent (H-1) for gelatin, an antiseptic and antifungal agent for gelatin, 1,2-benzisothiazoline-3-one, 2-phenoxyethanol, phenethyl alcohol and surfactant were added to each layer.

Coating was carried out by using the same slide hopper type coating equipment as that used in Example 1. Coating conditions were such that coating speed was 100 m/min, bead back pressure was 30 mm $H_2O$ and bead space was 250 μm. The temperatures of the liquid compositions were in the range of 38° to 39.5° C.

The viscosity and coating amount of each layer are shown in Table 2.

The arithmetic mean viscosity of the coating liquid compositions for the second to fifteenth layers was 115 cp. The sum total of the coating amounts was 180 ml/m$^2$.

Thus, there was obtained a negative color film made according to a process of the present invention which was free from the problem of color non-uniformity and which gave an image of good quality.

TABLE 2

| Coated Layer No. | Viscosity (cp) | Coating Amount (ml/m$^2$) |
|---|---|---|
| 1 | 50 | 15 |
| 2 | 100 | 15 |
| 3 | 120 | 10 |
| 4 | 140 | 20 |
| 5 | 110 | 15 |
| 6 | 110 | 10 |
| 7 | 130 | 10 |
| 8 | 120 | 10 |
| 9 | 120 | 15 |
| 10 | 150 | 5 |
| 11 | 110 | 15 |
| 12 | 100 | 10 |
| 13 | 130 | 10 |
| 14 | 110 | 10 |
| 15 | 60 | 10 |

The emulsions and the compounds which were used in this example are shown below.

| Emulsion | | | | | |
|---|---|---|---|---|---|
| Emulsion* | Average AgI Content (mol %) | Mean Grain Size (μm) | Coefficient of Variation in Grain Size (%) | Ratio of Diameter to Thickness | Ratio of Silver Amount (AgI Content mol %) Ag Ratio of Core/Shell |
| A | 4.0 | 0.45 | 27 | 1 | 1/2 (13/1) |
| B | 8.9 | 0.70 | 14 | 1 | 3/7 (25/2) |
| C | 10.0 | 0.75 | 30 | 2 | 1/2 (24/3) Double |
| D | 16.0 | 1.05 | 35 | 2 | 4/6 (40/0) Structural |
| E | 10.0 | 1.05 | 35 | 3 | 1/2 (24/3) Grain |
| F | 4.0 | 0.25 | 28 | 1 | 1/3 (13/1) |
| G | 14.0 | 0.75 | 25 | 2 | 1/2 (42/0) |
| H | 14.5 | 1.30 | 25 | 3 | 37/63 (34/3) |
| I | 1.0 | 0.07 | 15 | 1 | Uniform Grain |

*Silver halide in emulsions was silver bromoiodide

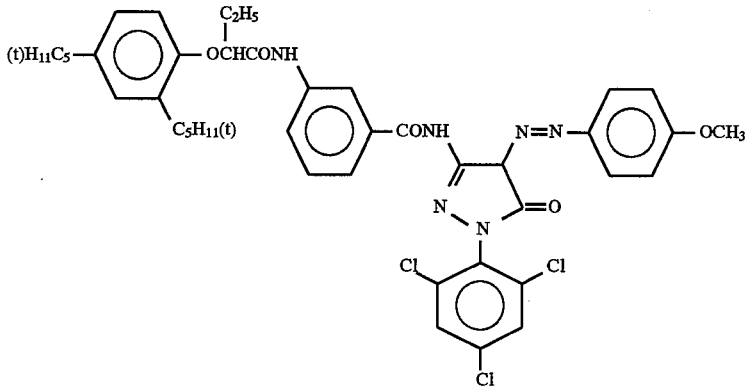

(EX-1)

-continued
(EX-2)
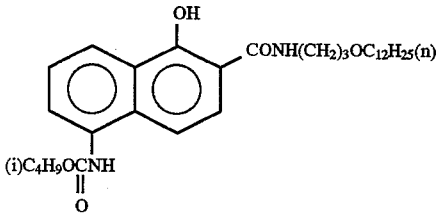
(EX-3)
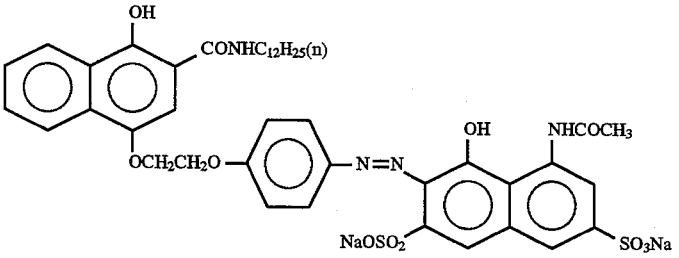
(EX-4)
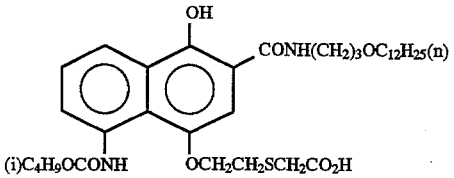
(EX-5)
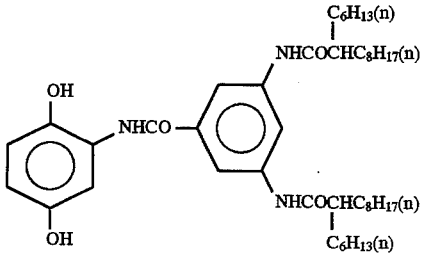
(EX-6)
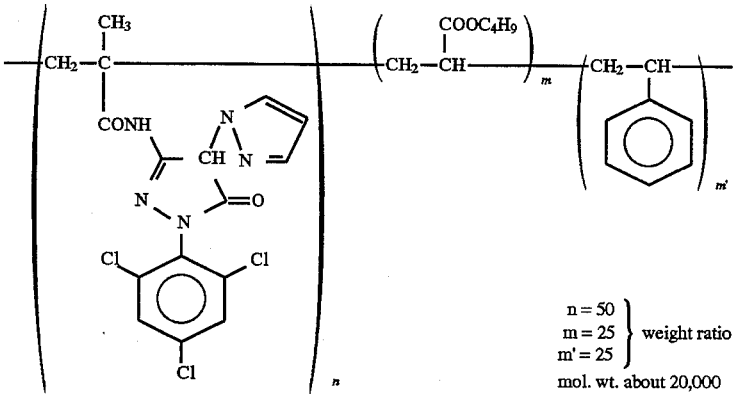

-continued
(EX-7)
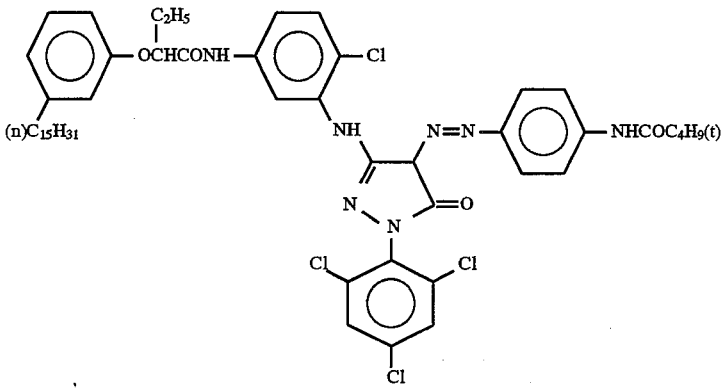
(EX-8)
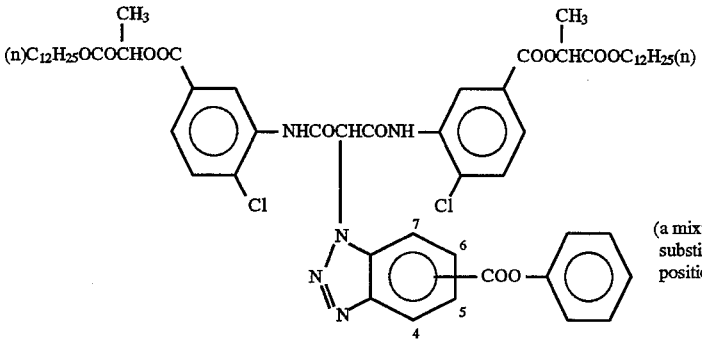
(a mixture of compounds substituted at 5– or 6– position)
(EX-9)
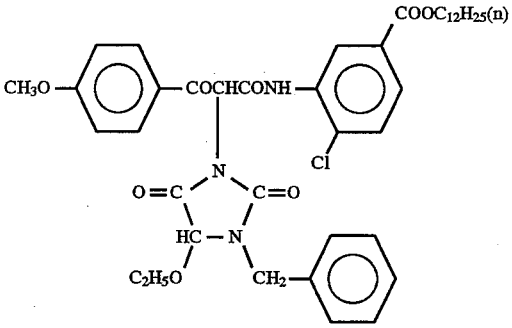
(EX-10)
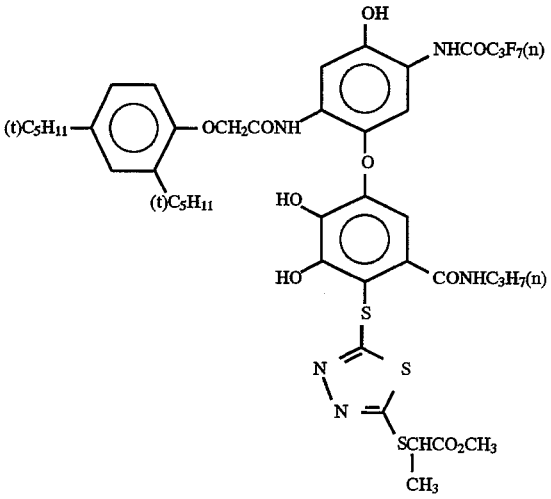

-continued
(EX-11)
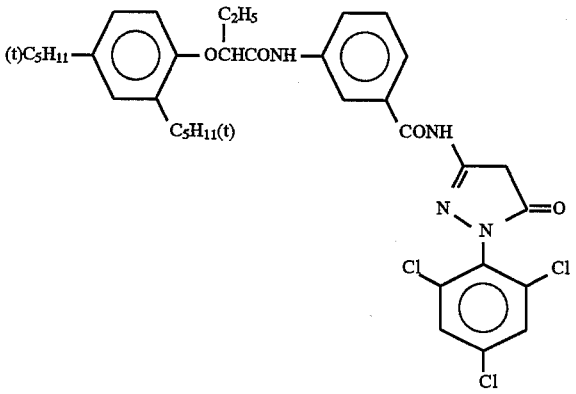
(EX-12)
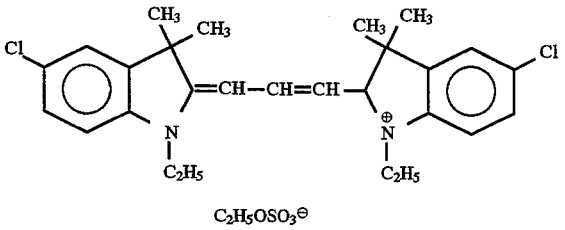
(EX-13)
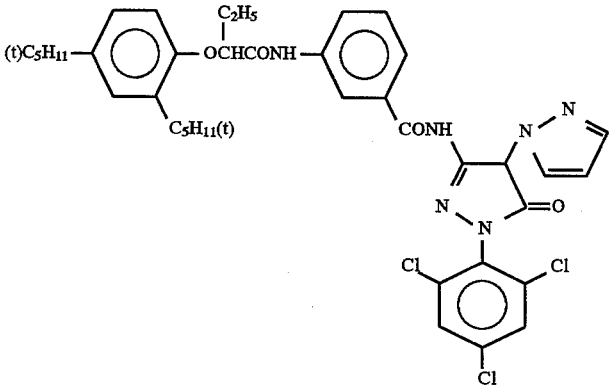
(U-1)
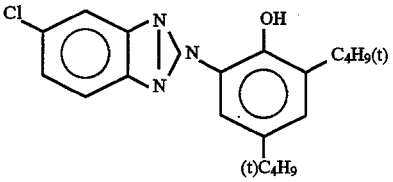
(U-2)
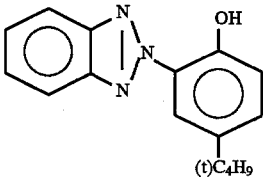
(U-3)
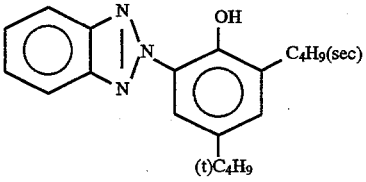

-continued
(U-4)
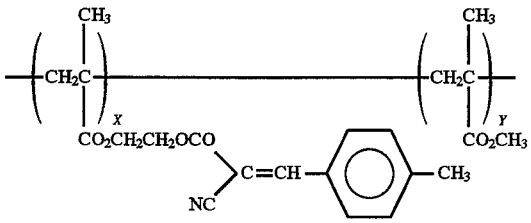
X:Y = 70:30(wt %)
(U-5)
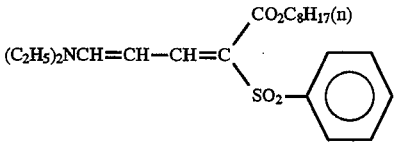
Tricresyl phosphate (HBS-1)
Di-n-butyl phthalate (HBS-2)
(HBS-3)
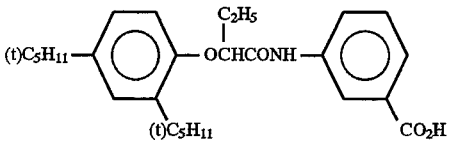
Sensitizing dye I
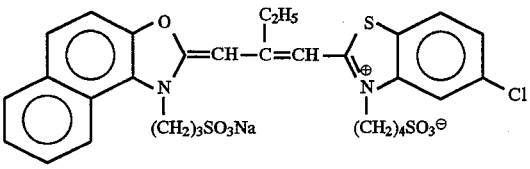
Sensitizing dye I
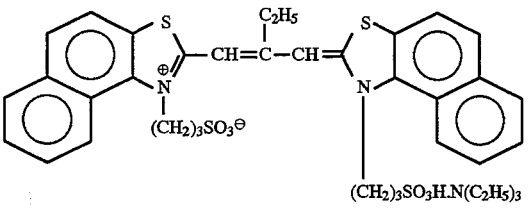
Sensitizing dye III
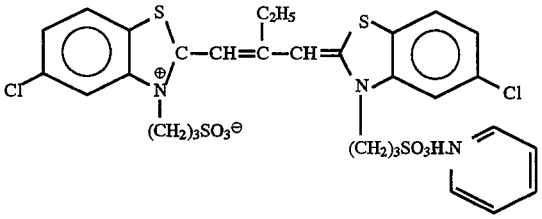
Sensitizing dye V
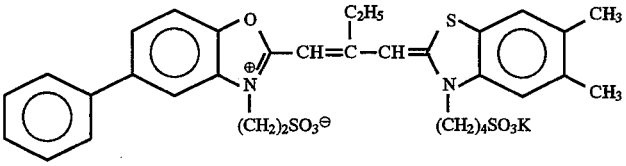
Sensitizing dye VI
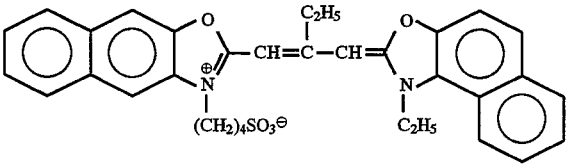

-continued

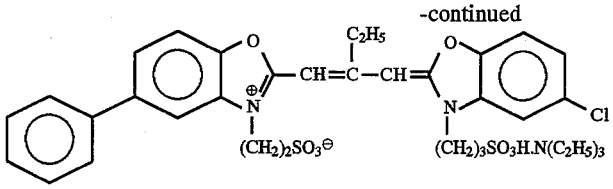

Sensitizing dye VII

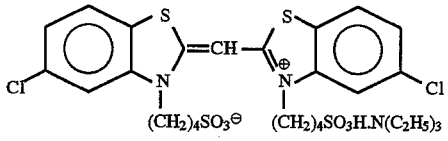

Sensitizing dye VIII

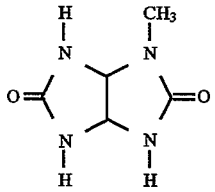

(S-1)

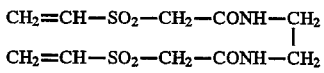

(H-1)

EXAMPLE 3

A paper support (conventional polyethylene was laminated on one side thereof, and polyethylene containing titanium white was laminated on other side thereof) was coated (on the side having a layer containing titanium white) with photographic layers comprising the following ten layers. The polyethylene-laminated paper had irregularities of 1 to 4 μm in depth, and the pitches thereof were distributed at intervals of 1 to 4 mm.

Co-coating was carried out at a coating speed of 150 m/min by delivering coating solutions indicated in Table 3 to the slits of the multi-layer slide hopper type coating equipment in order (bead back pressure and bead space being the same as those of Example 2). The temperatures of the coating compositions were in the range of 38° to 39.5° C. The coated support was dried for 2 minutes to prepare a reversal color paper having ISO sensitivity of 25.

Composition of Photographic Layer

Numerals given below for ingredients set forth coating weights (g/m$^2$). The amounts of silver halide emulsions are represented by coating weight in terms of silver. The adjustment of viscosity was made by adding a thickening agent composed of an aqueous solution of poly(sodium p-styrenesulfonate) in the same manner as in Example 1.

| | |
|---|---|
| First Layer: Low-sensitivity Red-sensitive Layer | |
| Silver iodobromide spectral-sensitized with red sensitizing dyes (*1 and *2, *, as described below) (silver iodide content: 5.0 mol %, mean grain size: 0.4 μm) | 0.15 |
| Gelatin | 1.00 |
| Cyan coupler (*3) | 0.14 |
| Cyan coupler (*4) | 0.07 |
| Anti-fading agent (*5, *6 and *7) | 0.10 |
| Solvent (*8 and *9) for coupler | .0.06 |
| Second Layer: High-sensitivity Red-sensitive Layer | |
| Silver iodobromide spectral-sensitized with red sensitizing agents (*1 and *2) (silver iodide content; 6.0 mol %, mean grain size: 0.7 μm) | 0.15 |
| Gelatin | 1.00 |
| Cyan coupler (*3) | 0.20 |
| Cyan coupler (*4) | 0.10 |
| Anti-fading agent (*5, *6 and *7) | 0.15 |
| Solvent (*8 and *9) | 0.10 |
| Third Layer: Interlayer | |
| Magenta colloidal silver | 0.02 |
| Gelatin | 1.00 |
| Anti-fading agent (*10) | 0.08 |
| Solvent (*11 and *12) for anti-fading agent | 0.16 |
| Polymer latex (*13) | 0.10 |
| Fourth Layer: Low-sensitivity Green-sensitive Layer | |
| Silver iodobromide spectral-sensitized with green sensitizing agent (*14) (silver iodide content: 2.5 mol %, mean grain size: 0.4 μm) | 0.10 |
| Gelatin | 0.80 |
| Magenta coupler (*15) | 0.10 |
| Anti-fading agent (*16) | 0.10 |
| Stain inhibitor (*17) | 0.01 |
| Stain inhibitor (*18) | 0.001 |
| Solvent (*11 and *19) for coupler | 0.15 |
| Fifth Layer: High-sensitivity Green-sensitive Layer | |
| Silver iodobromide spectral-sensitized with green sensitizing dye (*14) (silver iodide content: 3.5 mol %, mean grain size: 0.9 μm) | 0.10 |
| Gelatin | 0.80 |
| Magenta coupler (*15) | 0.10 |
| Anti-fading agent (*16) | 0.10 |
| Stain inhibitor (*17) | 0.01 |
| Stain inhibitor (*18) | 0.001 |
| Solvent (*11 and *19) for coupler | 0.15 |
| Sixth Layer: Yellow Filter Layer | |
| Yellow colloidal silver | 0.20 |
| Gelatin | 1.00 |
| Anti-fading agent (*10) | 0.06 |
| Solvent (*11 and *12) for anti-fading agent | 0.15 |
| Polymer latex (*13) | 0.10 |

-continued

| | |
|---|---|
| Seventh Layer: Low-sensitivity Blue-sensitive Layer | |
| Silver iodobromide spectral-sensitized with blue sensitizing agent (*20) (silver iodide content: 2.5 mol %, mean grain size: 0.5 μm) | 0.15 |
| Gelatin | 0.50 |
| Yellow coupler (*21) | 0.20 |
| Stain inhibitor (*18) | 0.001 |
| Solvent (*9) for coupler | 0.05 |
| Eighth Layer: High-sensitivity Blue-sensitive Layer | |
| Silver iodobromide spectral-sensitized with blue sensitizing dye (*20) (silver iodide content: 2.5 mol %, mean grain size: 1.2 μm) | 0.25 |
| Gelatin | 1.00 |
| Yellow coupler (*21) | 0.40 |
| Stain inhibitor (*18) | 0.002 |
| Solvent (*9) for coupler | 0.10 |
| Ninth Layer: Ultraviolet Light Absorbing Layer | |
| Gelatin | 1.50 |
| Ultraviolet Light Absorber (*22, *6 and *7) | 1.00 |
| Anti-fading agent (*23) | 0.06 |
| Solvent (*9) for anti-fading agent | 0.15 |
| Irradiation preventing dye (*24) | 0.02 |
| Irradiation preventing dye (*25) | 0.02 |
| Tenth Layer: Protective Layer | |
| Fine particles of silver chlorobromide (silver chloride content: 97 mol %, mean grain size: 0.2 μm) | 0.07 |
| Gelatin | 1.50 |
| Hardening agent for gelatin (*26) | 0.17 |

The above ten layers were co-coated by multi-layer co-coating.

The reagents used in the above-described layers are the following compounds.

(*1): 5,5'-Dichloro-3,3'-di(3-sulfobutyl)-9-ethylthia carbocyanine (Na salt).

(*2): Triethylammonium-3-[2-{2-[3-(3-sulfopropyl)-naphtho (1,2-d)thiazoline-2-indenemethyl]-1-butenyl}-3-naphtho(1,2-d)thiazolino]propane-sulfonate (*3): 2-[α-(2,4-Di-t-amylphenoxy)hexaneamido]-4,6-dichloro-5-ethylphenol (*4): 2-[2-chlorobenzoylamido]-4-chloro-5-[α-(2-chloro-4-t-amylphenoxy)octaneamido]-phenol (*5): 2-(2-Hydroxy-3-sec-5-t-butylphenyl)benztriazole (*6): 2-(2-Hydroxy-5-t-butylphenyl)benztriazole (*7): 2-(2-Hydroxy-3,5-di-t-butylphenyl)-6-chlorobenztriazole (*8): Di(2-ethylhexyl)phthalate (*9): Trinonyl phosphate (*10): 2,5-Di-t-octylhydroquinone (*11): Tricresyl phosphate (*12): Dibutyl phthalate (*13): Polyethyl acrylate (*14): Na salt of 5,5'-diphenyl-9-ethyl-3,3'-disulfopropyloxacarbocyanine (*15): 7-Chloro-6-methyl-2-{1-(2-octyloxy-5-t-octylbezene-sulfoneamido)-2-propyl}-1H-pyrazolo [1,5-b][1,2,4]triazole (*16): 3,3,3',3'-Tetramethyl-5,6,5',6'-tetrapropoxy-1,1'-bis-spiroindane (*17): 3-(2-Ethylhexyloxycarbonyloxy)-1-(3-hexadecyloxyphenyl)-2-pyrazoline (*18): 2-Methyl-5-t-octylhydroquinone (*19): Trioctyl phosphate (*20): Triethylammonium 3-[2-(3-benzylrhodanine-5-indene)-3-benzoxazolinyl]propanesulfonate (*21): α-Pivaloyl-α-[(2,4-dioxo-1-benzyl-5-ethoxy-hydantoin-3-yl)-2-chloro-5-( α-2,4-di-t-amylphenoxy) butaneamido]acetanilide (*22): 5-Chloro-2-(2-hydroxy-3-t-butyl-5-t-octyl)-phenylbenztriazole (*23): 2,5-Di-sec-octylhydroquinone (*24):

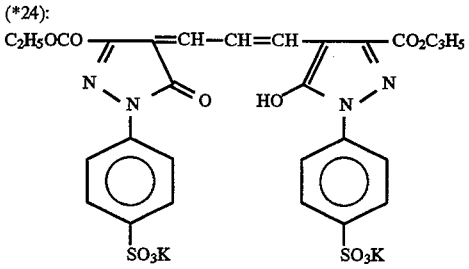

(*25):

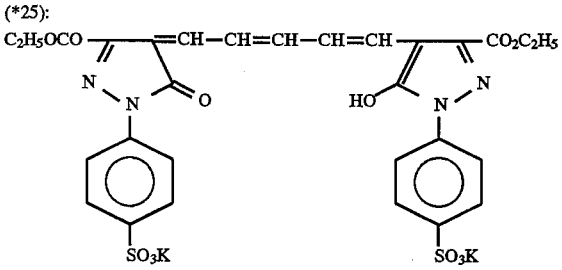

(*26): 1,2-Bis(vinylsulfonylacetamido)ethane

TABLE 3

| Layer | Viscosity (cp) | | | | | Coating Amount ml/m² |
|---|---|---|---|---|---|---|
| No. | Condition A | Condition B | Condition C | Condition D | Condition E | A–E |
| 1 | 30 | 10 | 180 | 30 | 50 | 15 |
| 2 | 30 | 150 | 150 | 150 | 100 | 15 |
| 3 | 30 | 150 | 150 | 150 | 100 | 10 |
| 4 | 30 | 150 | 150 | 150 | 100 | 15 |
| 5 | 30 | 150 | 150 | 150 | 100 | 15 |
| 6 | 30 | 150 | 150 | 150 | 100 | 10 |
| 7 | 30 | 150 | 150 | 150 | 100 | 15 |

TABLE 3-continued

| Layer No. | Viscosity (cp) Condition A | Condition B | Condition C | Condition D | Condition E | Coating Amount ml/m² A–E |
|---|---|---|---|---|---|---|
| 8 | 30 | 150 | 150 | 150 | 100 | 15 |
| 9 | 30 | 150 | 150 | 150 | 100 | 10 |
| 10 | 30 | 150 | 150 | 150 | 100 | 10 |
| Mean viscosity | 30 | 150 | 150 | 150 | 100 | — |
| Total coating amount | — | — | — | — | — | 130 |

The following results were obtained.

With regard to the Conditions A, B, D and E, the resulting samples were subjected to neutral grey uniform exposure and then developed by processing described in JP-A-1-106047 (pages 27 to 28: corresponding to U.S. Pat. No. 4,935,337). The color non-uniformity of the resulting samples was compared.

Condition A: Color non-uniformity corresponding to irregularities on the surface of the support was found.

Condition B: Running color non-uniformity was found.

Condition C: Coating was poorly made and was not tested further.

Condition D: There was obtained a uniform coated surface which was free from the problem of color non-uniformity.

Condition E: Good results were obtained as in the Condition D.

It is apparent from the above results that the Conditions D and E, which meet requirements according to the present invention, give good surface uniformity and color uniformity.

By processes for preparing a color light-sensitive material according to the present invention, (1) it becomes possible that there can be obtained a color light-sensitive material which is free from color non-uniformity and has a uniform coated surface by coating simultaneously at least about 8 photographic layers in a single co-coating process;

(2) the fogging of red-sensitive emulsion layers can be kept at a low level even when the same drying temperature and humidity are used, this fogging of red-sensitive emulsion layers being increased by conventional two or more co-coating operations; and (3) a color light-sensitive material, particularly a color light-sensitive material for photographing can be co-coated at a high speed.

Accordingly, the present invention substantially contributes to improvements in the quality of color light-sensitive material, and the productivity thereof, at a reduced in cost.

While the invention has been described in detail and with reference to specific embodiments thereof, it will be apparent to one skilled in the art that various changes and modifications can be made therein without departing from the spirit and scope thereof.

What is claimed is:

1. A process for multi-layer, co-coating preparation of a silver halide color light sensitive material, said process comprising co-coating at least eight coating liquid compositions simultaneously onto a traveling support to form at least eight total layers comprising a lowermost layer adjacent to said support and at least seven outer layers adjacent to said lowermost layer, wherein (A) said at least eight coating liquid compositions comprise a lowermost layer coating liquid composition and at least seven outer coating liquid compositions;

(B) said lowermost layer coating liquid composition has a viscosity of 15 to 100 cp;

(C) each outer layer coating liquid composition of said at least seven outer layer liquid compositions has a viscosity of 30 to 300 cp;

(D) said at least seven outer layer coating liquid compositions have an arithmetic mean viscosity of 60 to 300 cp;

(E) said at least eight total layers are coated in a total coating amount of at most 300 ml/m²; and (F) each of said at least eight total layers is coated in a coating amount of at least about 3 ml/m²; and wherein said viscosities are each measured at a shear rate of 29.8 mm/sec at a coating temperature of 39°±1° C.

2. A process according to claim 1, wherein said lowermost layer coating liquid composition has a viscosity of 20 to 70 cp.

3. A process according to claim 1, wherein said lowermost layer coating liquid composition has a viscosity of 20 to 60 cp.

4. A process according to claim 1, wherein each of said at least seven outer layer coating liquid compositions has a viscosity of 70 to 250 cp.

5. A process according to claim 1, wherein each of said at least seven outer layer coating liquid compositions has a viscosity of 80 to 200 cp.

6. A process according to claim 1, wherein said at least seven outer layer coating liquid compositions have an arithmetic mean viscosity of 70 to 250 cp.

7. A process according to claim 1, wherein said at least seven outer layer coating liquid compositions have an arithmetic mean viscosity of 80 to 200 cp.

8. A process according to claim 1, wherein said at least eight total layers are coated in a total coating amount of at most 250 ml/m².

9. A process according to claim 1, wherein each of said at least eight total layers is coated in a coating amount of 5 to 50 ml/m².

10. A process according to claim 1, wherein the first outer layer coating liquid composition of said at least seven outer layer liquid compositions which is co-coated adjacent to said lowermost layer coating liquid compositions has a viscosity of at least 1.5 times the viscosity of said lowermost coating solution.

11. A process according to claim 10, wherein said first outer layer coating liquid composition has a viscosity of at most 5.0 times the viscosity of said lowermost coating solution.

12. A process according to claim 1, wherein said at least eight total layers comprise 8 to 20 layers.

13. A process according to claim 1, wherein said traveling support travels at a rate of 30 to 500 m/min.

14. A process according to claim 1, wherein a surface of said at least eight total layers has irregularities of less than 5 μm in depth.

15. A process according to claim 14, wherein the space between pitches of said irregularities is outside the range of 0.5 to 8 mm.

16. A process according to claim 1, wherein the coated photographic layers are immediately cooled after coating to solidify them.

17. A process according to claim 16, wherein the photographic layers are dried after solidifying.

18. The process according to claim 1, wherein said coating temperature is 40° C.

19. A process according to claim 1, wherein the viscosity of the coating liquid composition for the second layer adjacent to the lowermost layer is higher than that of the coating liquid composition for the lowermost layer.

20. A process according to claim 1, wherein said at least eight total layers comprises 10 to 18 layers.

21. A process according to claim 1, wherein the coating liquid composition for the layers contains gelatin as a binder.

22. A process for multi-layer, co-coating preparation of a silver halide color light sensitive material, said process comprising co-coating at least eight coating liquid compositions simultaneously onto a traveling support to form at least eight total layers comprising a lowermost layer adjacent to said support and at least seven outer layers adjacent to said lowermost layer, wherein (A) said at least eight coating liquid compositions comprise a lowermost layer coating liquid composition and at least seven outer coating liquid compositions;

(B) said lowermost layer coating liquid composition has a viscosity of 15 to 100 cp;

(C) each outer layer coating liquid composition of said at least seven outer layer liquid compositions has a viscosity of 30 cp to 300 cp;

(D) said at least seven outer layer coating liquid compositions have an arithmetic mean viscosity of 60 to 300 cp;

(E) said at least eight total layers are coated in a total coating amount of at most 300 ml/m$^2$; and (F) each of said at least eight total layers is coated in a coating amount of at least 3 ml/m$^2$;

wherein said viscosities are each measured at a shear rate of 29.8 mm/sec at a coating temperature of 39°±1° C.; and wherein the coated photographic layers are immediately cooled after coating to solidify them;

the photographic layers are dried after solidifying; and the drying is carried out by spraying air at a dry-bulb temperature of about 15° to 45° C. and a relative humidity of about 10 to 15%, with an air flow of about 10 to 40 m$^3$/m$^2$·min.

23. The process according to claim 1, wherein the total number of layers is 9 or 10.

* * * * *